US007066369B2

(12) United States Patent
Gantner et al.

(10) Patent No.: US 7,066,369 B2
(45) Date of Patent: Jun. 27, 2006

(54) PROPELLANT CONTAINER FOR SETTING TOOLS AND AN INTERNAL COMBUSTION DRIVEN SETTING TOOL

(75) Inventors: Gebhard Gantner, Nenzing (AT); Ulrich Rosenbaum, Wangs (CH); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/828,762

(22) Filed: Apr. 20, 2004

(65) Prior Publication Data

US 2004/0211809 A1 Oct. 28, 2004

(30) Foreign Application Priority Data

Apr. 24, 2003 (DE) ..... 103 18 555

(51) Int. Cl.
*B25C 1/10* (2006.01)

(52) U.S. Cl. ..... 227/9; 102/200; 227/10

(58) Field of Classification Search ..... 227/9, 227/10, 11, 130, 131; 102/200, 202.5
See application file for complete search history.

(56) References Cited

U.S. PATENT DOCUMENTS 4,072,107 A * 2/1978 Saxe et al. ..... 102/388
4,127,243 A * 11/1978 Jacobson et al. ..... 244/3.21
4,157,068 A * 6/1979 Rognmo ..... 102/489
4,705,200 A * 11/1987 Kopf et al. ..... 227/9
4,930,421 A * 6/1990 Macdonald ..... 102/377
6,179,192 B1 * 1/2001 Weinger et al. ..... 227/8
6,357,534 B1 * 3/2002 Buetow et al. ..... 173/217
6,644,293 B1 * 11/2003 Jong ..... 124/52
6,722,549 B1 * 4/2004 Shkolnikov et al. ..... 227/10

* cited by examiner

*Primary Examiner*—Scott A. Smith
*Assistant Examiner*—Gloria R. Weeks
(74) *Attorney, Agent, or Firm*—Abelman, Frayne & Schwab

(57) ABSTRACT

The present invention relates to a propellant container (2) for an internal combustion operated setting tool (10) having a housing (21) and a housing internal space (22) for receiving a propellant (23). A portable electrical power source (40) such as a battery or a battery pack is arranged on the propellant container (2). The invention further relates to an internal combustion operated setting tool (10) having electrical consumers (30), a setting mechanism (12) that can be driven by a propellant (23) and a receptacle (15) for a propellant container (20). Contact elements (31, 32) for contacting an electrical power source arranged on the propellant container (20) are arranged on the receptacle for the propellant container (20).

6 Claims, 4 Drawing Sheets

Fig. 2
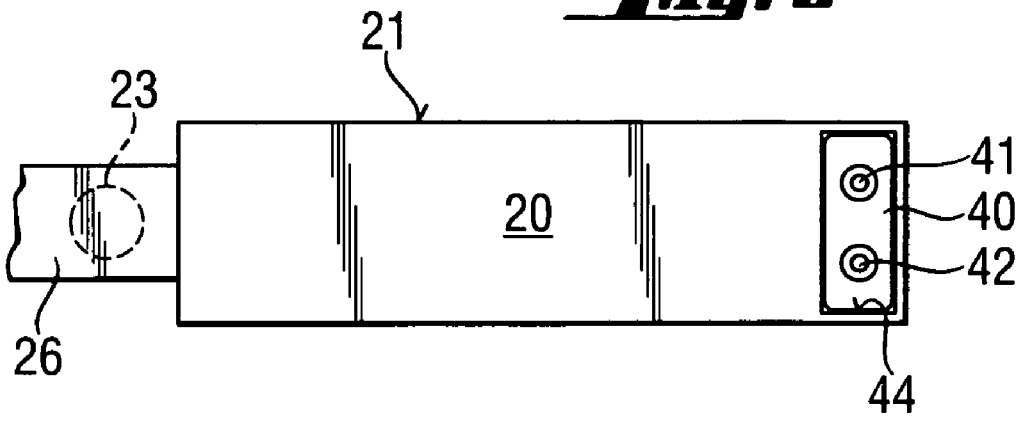
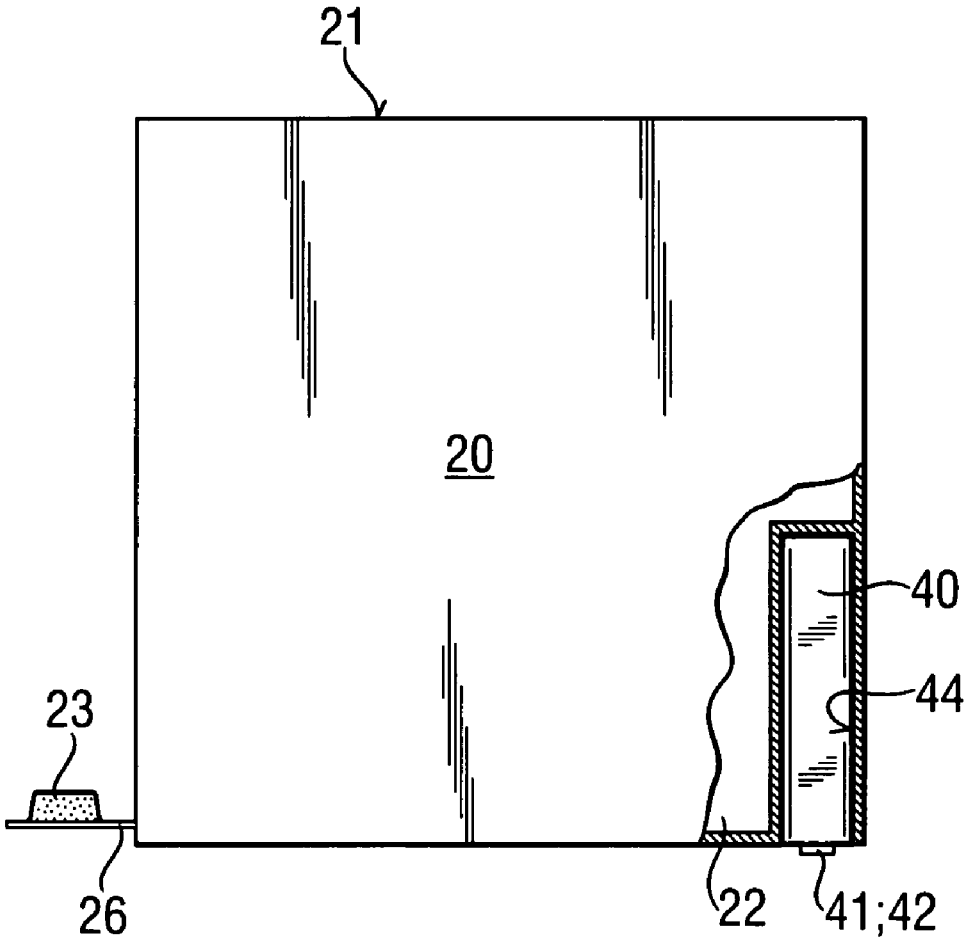
Fig. 3

PROPELLANT CONTAINER FOR SETTING TOOLS AND AN INTERNAL COMBUSTION DRIVEN SETTING TOOL

BACKGROUND OF THE INVENTION

The present invention relates to a propellant gas container for an internal combustion operated setting tool for driving in fastening elements such as nails, bolts, pins into a substrate. The propellant container has a housing and a housing inner space for receiving propellant, wherein a portable electrical power supply such as a battery or battery pack is arranged on the propellant container. The energy contents of the electrical power supply is adapted to the propellant content of the propellant container. This type of propellant gas container can be filled with powder fuels such as pills or cartridges but can also be filled with liquid or gaseous fuels. These propellants are used in the setting tool for driving a setting mechanism.

U.S. Pat. No. 4,204,473 discloses a fuel operated setting tool and a cartridge strip with a number of powder charges, wherein the cartridge strip is arranged in a magazine box serving as the propellant container. The cartridges or the magazine strip are arranged in the magazine box in layers.

Gaseous or fluid fuels are provided in propellant as pressure containers. DE 197 46 018 C2 discloses this type of pressure container.

Increasingly electrical consuming mechatronic functions are being provided in the setting tools in such internal combustion operated setting tools. Accordingly, U.S. Pat. No. 4,483,280 discloses a setting tool in which an electrically operated fan is provided for flushing the combustion chamber. In this device, the required electrical power is provided by batteries arranged in a battery compartment. The propellant container is arranged as a pressure vessel in a separate compartment in the housing of the setting tool.

The drawback in such a device is that the housing must have two compartments, which results in higher manufacturing costs. Also, an operator must change the pressure vessel and the batteries separately when they are depleted.

SUMMARY OF THE INVENTION

The object of the present invention is to develop a propellant container and a setting tool, wherein the aforementioned drawbacks are eliminated and the operator is provided with easy handling of the setting tool and propellant container.

This object is achieved according to the invention wherein, a portable electrical power source, such as a battery or a battery pack, is arranged on the propellant container. By virtue of this process, the operator of a setting tool must change only the propellant container, when same is empty, whereby time is saved. In addition, the structural space in the setting tool is economized, because a separate receptacle no longer has to be provided for the electrical power source.

In an advantageous embodiment of the invention, the electrical power source is removable/replaceable and arranged in a receptacle on the propellant container. By virtue of the arrangement in a receptacle, the battery can be removed from the propellant container, whereby separate disposal or even re-utilization of the electrical power source (e.g. in another propellant container) is possible.

Such advantages are presented if the electrical power source is removably/replaceably mounted on the propellant container using a clip-on fastening.

In a variant that can be economically manufactured, the electrical power source is mounted on the propellant container using an adhesive fastening means.

In an advantageous further development of the invention, the power unit of the electrical power source is adapted to the propellant unit of the propellant container. Accordingly, the energy stored in the electrical power source, with a propellant unit of the propellant container for 100 setting operations, covers the power supply of the electrical power consumer of the setting tools for said 100 setting operations.

In a setting tool according to the invention, it is advantageous if contact elements are arranged on or in the zone of the receptacle for the propellant container for contacting the electrical power source arranged on the propellant container. By virtue of this feature, the operator of a setting tool must change only the propellant container when same is empty, whereby time is saved. In addition, the structural space in the setting tool is economized because a separate receptacle no longer has to be provided for the electrical power source.

BRIEF DESCRIPTION OF THE DRAWINGS

Other advantages and features of the invention will become apparent from the following description with reference to the drawings, wherein:

FIG. 2 shows a variant of the propellant container of FIG. 1 viewed from below;

FIG. 3 shows the propellant container of FIG. 2 in a partially cut-away side view;

DETAILED DESCRIPTION OF THE INVENTION

Figure 1:
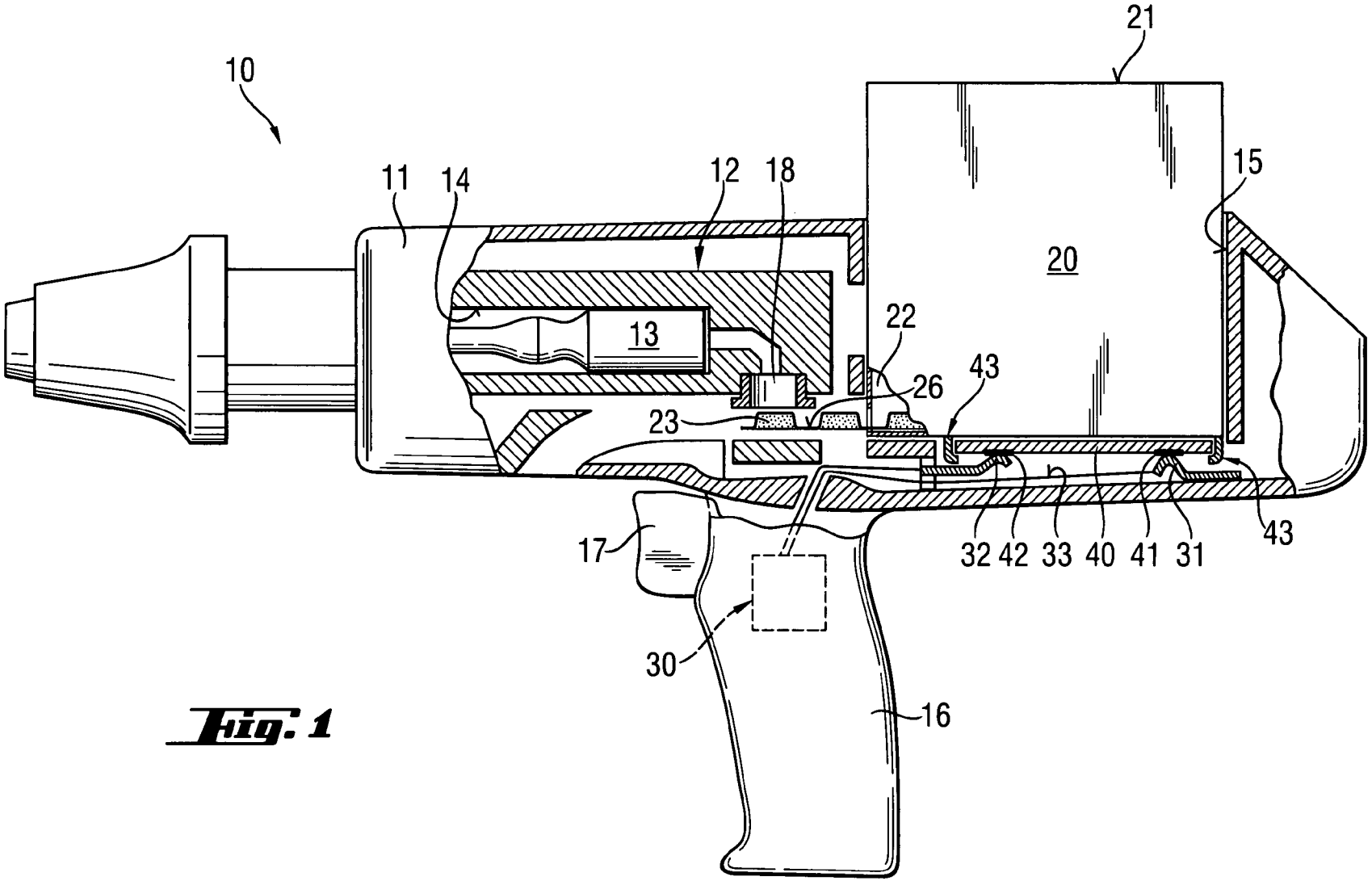
FIG. 1 shows a setting tool according to the invention in partial longitudinal sectional view with a propellant container situated in a receptacle.

FIG. 1 shows a first embodiment of a propellant container 20 according to the invention in a setting tool 10. The setting tool 10 has a housing 11, in which a setting mechanism is arranged, which has a drive piston 13 situated in a piston guide 14 or a piston chamber and a cartridge chamber 18 for receiving a propellant 23, such as a solid propellant charge on a blister strip 26. A propellant 23 situated in the cartridge chamber can be electrically or electromechanically fired using a firing unit (not shown here). After firing, the drive piston 13 is driven by the expanding gases of the explosion and accordingly can perform a setting operation such as driving a nail or bolt situated in the bolt guide of the setting tool 10 into a substrate (not diagrammatically represented herein). The tool represented here further includes a handle 16, on which a trigger switch is arranged for triggering a setting operation. At least one electrical consumer 30 such as a control circuit, a firing circuit, a data processing unit or etc. [sic] is arranged in the setting tool.

Furthermore, yet another receptacle 15 for a propellant container 20 is arranged in the setting tool 10, wherein the propellant container 20 can be temporarily inserted. In this case, guide means (not diagrammatically represented herein) can prescribe the correct insertion orientation of the propellant container 20. Spring-elastic electrical contact elements 31, 32 are arranged on the floor of the receptacle 15. The contact elements are connected via electrical lines 33, 34 with the electrical consumers 30.

The propellant container 20 has a housing 21 with a housing internal space 22, wherein the propellant 23 in the form of solid propellant charges on a blister strip 26 is arranged. On a side wall of the housing 21, an electrical power source 40 is arranged in the form of a flat battery by a clip fastening 43. In this case, the electrical power source 40 can be replaceably arranged on the propellant container 20 using the clip fastening 43.

If the propellant container 20 is properly inserted into the receptacle 15 of the setting tool 10, then an electrical connection is established by the contact elements 41, 42 of the electrical power source 40 with the contact elements 31, 32 of the setting tool 10, which is then supplied via the electrical power source 40 with electrical power.

FIGS. 2 and 3 represent a further embodiment of a propellant container 20 according to the invention. The propellant container 20 differs from the previously represented one only in that the electrical power source 40 configured as a battery is replaceably arranged in a receptacle 44 of the propellant container 20.

Figure 4:
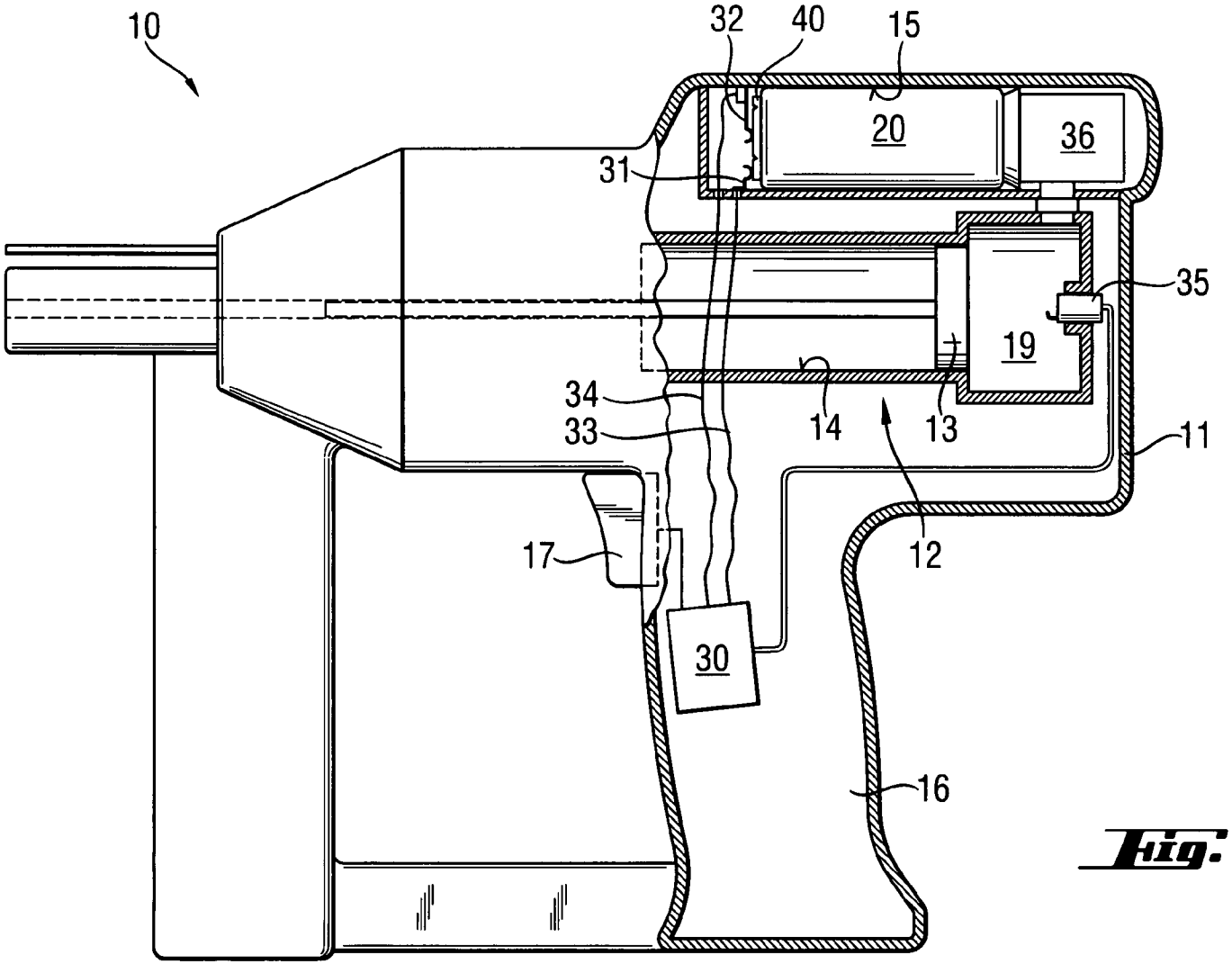
FIG. 4 shows a further embodiment of the setting tool according to the invention in partial longitudinal sectional view with a propellant container in a receptacle.

FIG. 4 represents a further embodiment of a setting tool 10 according to the invention, which can be operated using a liquid or a gaseous fuel as the propellant 23. This setting tool 10 differs from those previously described in that instead of a cartridge chamber, a combustion chamber 19 is arranged the one end of the piston guide 14, in which a fuel (propellant) air mixture can be ignited using a firing unit 35. When this is done, the propellant 23 or the fuel is dosed into the combustion chamber 19 by a dosing assembly 36 downstream of the propellant container. The electrical consumer 30 configured as a controller assembly supplies the firing signal after actuation of the trigger switch 17.

The receptacle 15 is capable of receiving a propellant container configured as a pressure container. This type of propellant container 20 is again detailed and enlarged and partially opened up in FIG. 5.

Figure 5:
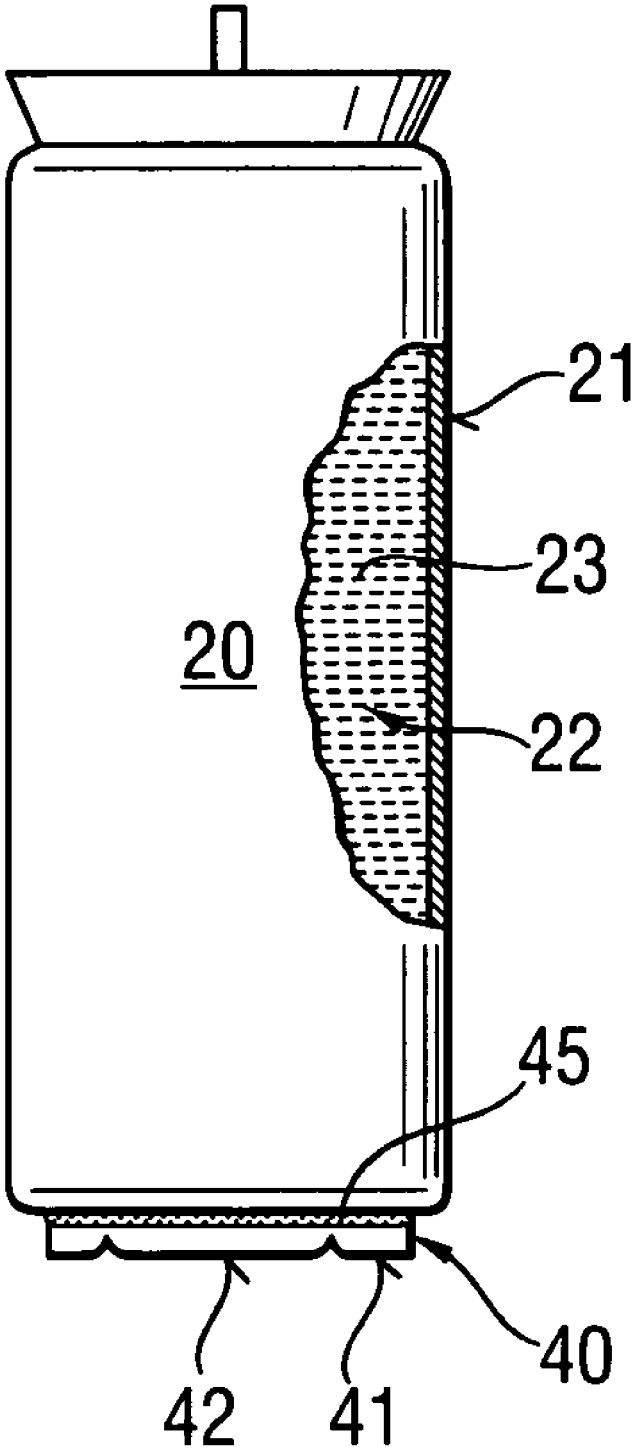
FIG. 5 shows the propellant container of FIG. 4 in an enlarged side view, in part cut-away.

The propellant container 20 configured as a pressure container in FIGS. 4 and 5 has a housing 21, in whose inside space 22 a propellant 23 is present in the form of a gaseous and/or liquid fuel. An electrical power source 40 is fastened by an adhesive fastening means 45 to the floor of the propellant container 20. The contact elements 41, 42 of the electrical power source 40 are electrically contacted via the contact elements 31, 32, when the propellant container 20 is inserted into the receptacle 15 of the setting tool 10 (compare FIG. 4), so that the setting tool 10 is supplied with electrical power.

What is claimed is:

1. A propellant container for internal combustion operated setting tools including electrical consumers (30) and having contact element (31, 32) for contacting an electrical power source (40) for supplying electrical power to the electrical consumers (30), the propellant container having a housing (21) and a housing inner space (22) for receiving solid propellant charges (23), wherein the portable electrical power supply (40) includes one of a battery and a battery pack is arranged on the propellant container (2) to be contacted by the contact elements (31, 32) of the setting tool.

2. The propellant container of claim 1, wherein the electrical power source (4) is arranged in a receptacle (44) on the propellant container (20).

3. The propellant container of claim 1, wherein the electrical power supply (40) is mounted on a propellant container (20) using a clip fastening (43).

4. The propellant container of claim 1, wherein the electrical power supply (40) is fastened to a propellant container (20) using an adhesive fastening (43).

5. The propellant container of claim 1, wherein the energy contents of the electrical power supply (40) is adapted to the propellant content of the propellant container (20).

6. A propellant container of claim 1, wherein the propellant container is received in a container receptacle of the setting tool in which the contact elements are arranged.

* * * * *